United States Patent [19]

Hare

[11] 4,103,796

[45] Aug. 1, 1978

[54] BUCKET ATTACHMENT FOR TRACTORS

[76] Inventor: Kenneth H. Hare, Rte. 5, Box 334-A, Greenville, Tex. 75401

[21] Appl. No.: 756,113

[22] Filed: Jan. 3, 1977

[51] Int. Cl.[2] ..... E02F 3/00

[52] U.S. Cl. ..... 214/766; 172/439; 37/118 R

[58] Field of Search ..... 37/118 R, 118 A, 103, 37/117.5, 124, 125, 126 R; 172/439, 529; 214/766

[56] References Cited

U.S. PATENT DOCUMENTS

| | | | |
|---|---|---|---|
| 1,459,566 | 6/1923 | Andrews | 37/124 |
| 2,398,991 | 4/1946 | Arps | 37/126 R |
| 2,415,156 | 2/1947 | Arps | 37/124 |
| 2,591,278 | 4/1952 | Morgan | 37/118 R |
| 2,622,749 | 12/1952 | Stuhr | 214/766 X |
| 3,319,367 | 5/1967 | Lewis | 37/118 R |

*Primary Examiner*—Clifford D. Crowder

*Attorney, Agent, or Firm*—Gerald G. Crustsinger; Larry B. Dwight

[57] ABSTRACT

Apparatus for attaching a bucket to a conventional three-point hitch on a tractor to control dumping of the bucket. The bucket is pivotally secured by stub shafts to a yoke-shaped frame. The frame is secured to the bottom portion of a three-point hitch and has an upwardly extending center post attached to the adjustable upper link of the three-point hitch. A rod, pivotally secured to the rear edge of the bucket, is slideably disposed through a sleeve pivotally secured to a lug attached to the center post. A stop member is pivotally secured to the lug over the sleeve and is spring-urged forward over the upper end of the rod to limit movement of the rod upwardly through the sleeve. When the stop member is pivoted rearwardly away from the rod by pulling a rope, the rod slides upwardly through the sleeve as the tractor moves forward dumping the contents of the bucket onto the ground.

11 Claims, 6 Drawing Figures

BUCKET ATTACHMENT FOR TRACTORS

BACKGROUND

Precision tools are required for grading and for purposes of cultivation or landscaping. In addition, it is often necessary to move dirt from one location to another. Heretofore, this has usually be accomplished by the use of a front end loader type vehicle having a hydraulically actuated bucket. However, these devices are usually expensive and not adaptable for use on the average farm tractor. Usually, grading requires a specially built tractor adapted for that purpose such that it is not suitable for other farming operations such as plowing, planting, and similar operations.

Most of the farming tractors in use today have a three-point hitch. The standard three-point hitch has two lower bars connectable to the farming implement and an upper link or bar which is connectable to the implement. The three bars may be elevated relative to the ground for moving the implement attached thereto relative to the ground.

Grading devices which have heretofore been attached to three-point hitches have been limited primarily to a blade or moldboard and have been inefficient for moving dirt from one location to another.

SUMMARY

I have devised an improved mounting apparatus for attaching a bucket to a conventional three-point hitch on the rear end of a conventional tractor.

A three-point hitch generally comprises a pair of lower bars spaced above the ground and a top link centered between and above the lower bars. The bars are moveable by an elevator mechanism which raises and lowers the bars and an implement attached to the bars.

The improved mounting apparatus comprises a yoke or frame having an upwardly extending center post attached thereto. The yoke is secured to the lower bars onto a three-point hitch and the upper end of the center post is pivotally secured to the top link of the three-point hitch.

Opposite ends of a bucket are pivotally secured to the yoke and one end of the rod is pivotally secured to the rear edge of the bucket, the other end of the rod being slideably disposed through a sleeve pivotally secured to the upper end of the center post on the yoke. A stop member, comprising a semi-cylindrical shaped member having lugs extending outwardly therefrom and a semicircular closure element secured to the upper end thereof, is pivotally secured over the sleeve and is adapted to limit upward movement of the rod through the sleeve. A stop cap is secured to the upper end of the rod to limit downward movement of the rod through the sleeve.

When the bucket is in a normal grading position, the rod is fully extended downwardly such that the stop cap is captured between the upper end of the sleeve and the stop member. When the tractor is moved forward, the bucket is filled with dirt. When the operator is ready to dump the bucket, he pulls a rope attached to a lever secured to the stop member, thereby moving the semicylindrical element away from the upper end of the rod. Movement of the tractor forward will then cause the bucket to pivot to a dump position.

The primary object of the invention is to provide a grading apparatus which is adapted to fit on a conventional three-point hitch of a farming tractor adapted for accurate control of the grading blade for precision grading.

A further object of the invention is to provide an apparatus which is attachable to the conventional farming tractor which is easily controlled and minimizes cost of operation.

A still further object of the invention is to provide a grading apparatus which does not require complicated hydraulic connections and which is easily removed from the tractor.

A still further object of the invention is to provide apparatus which allows for dumping of the bucket such that dirt may be removed from one area and transferred to another.

Other and further objects of the invention will become apparent upon a detailed study of the description hereinafter following and by referring to the drawings annexed hereto.

DESCRIPTION OF THE DRAWINGS

The drawings of the preferred embodiment of the invention are annexed hereto so that the invention may be better and more fully understood, in which.

Numeral references are used to designate the parts shown in the drawings and like numerals indicate like parts throughout the various figures of the drawing.

DESCRIPTION OF A PREFERRED EMBODIMENT

Numeral 6 generally designates a bucket apparatus secured to a conventional three-point hitch on a typical farm tractor shown in dashed outline.

Figure 1:
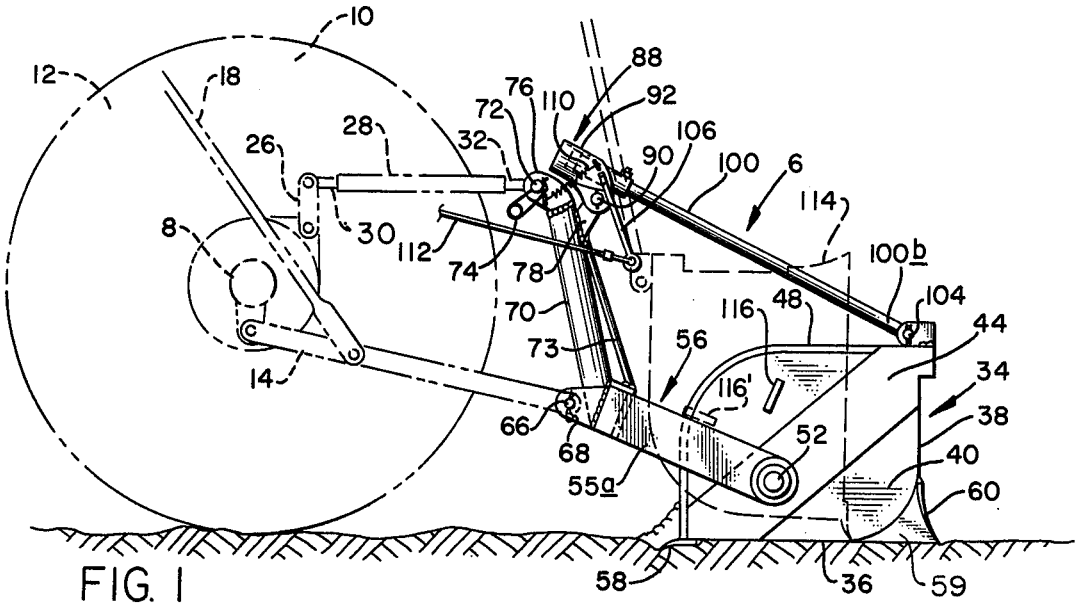
FIG. 1 is a side elevational view of the bucket mount attached to a typical tractor, shown in dashed outline.
Figure 3:
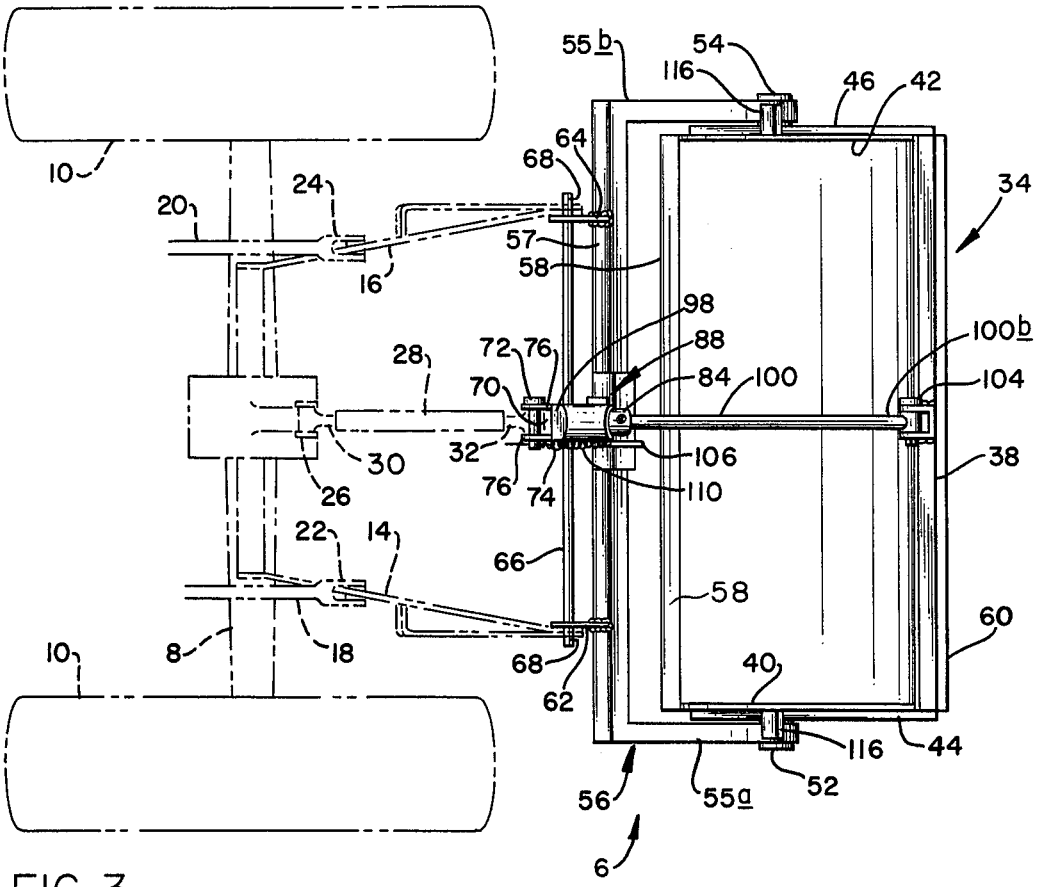
FIG. 3 is a plan view of the bucket mount attached to a typical tractor, shown in dashed outline.
Figure 4:
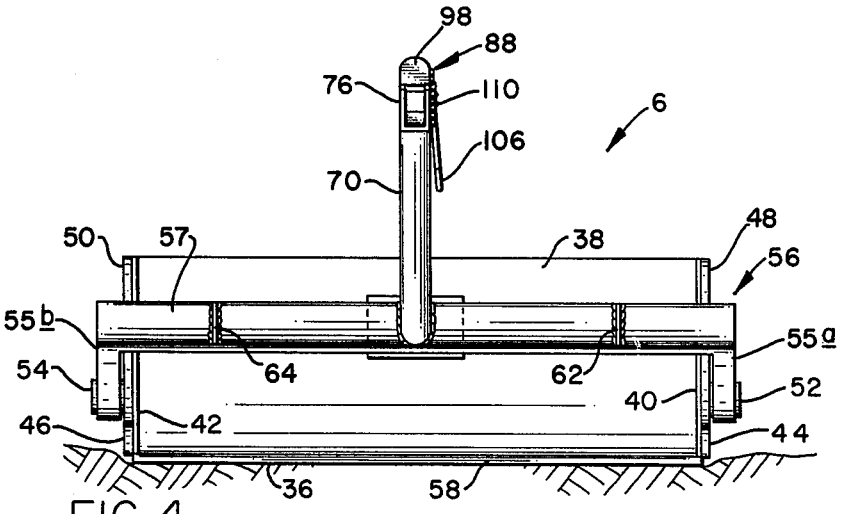
FIG. 4 is a front end elevational view of the bucket mount disconnected from the tractor.
Figure 5:
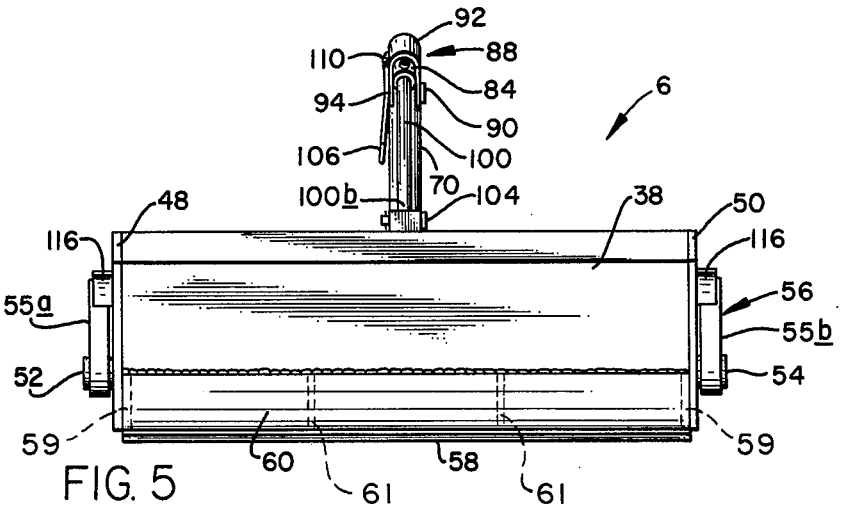
FIG. 5 is a rear end elevational view of the bucket mount disconnected from the tractor.

As best illustrated in FIGS. 1 and 3, the tractor generally comprises an axle 8 having wheels 10 and 12 rotatably secured thereto. A three-point hitch comprises a pair of lower bars 14 and 16 pivotally secured to lugs on the bottom of axle 8 and a connecting link 28 hereinafter described. The elevator mechanism (not shown) has control bars 18 and 20 pivotally secured by clevises 22 and 24 to the lower bars 14 and 16 of the three-point hitch. A connecting link 26 is pivotally secured to the upperside of axle housing 8 and is pivotally secured to the outer end of top link 28 of the three-point hitch. Top link 28 may be adjustable and preferably comprises a double acting hydraulic cylinder for controlling the length of the link having a first end 30 of the cylinder attached to link 26 and a piston rod 32 secured to the bucket 6. It should further be appreciated that upper link 28 may be an alternate adjustment member such as turnbuckle or other device for adjusting the length of the connection.

The bucket apparatus 6 generally includes an open, box shaped bucket 34, having a bottom 36 which is deflected upwardly to form the rear wall 38. The bottom 36 and rear wall 38 are connected to sidewalls 40 and 42 which are reinforced by angle members 44 and 46. Curved reinforcing bars 48 and 50 are secured to the upper edge of sidewalls 40 and 42.

Stub shafts 52 and 54 extend outwardly from opposite ends of the bucket 34 and are pivotally secured to opposite ends of the C-shaped yoke 56. Bucket 34 has a leading cutting blade 58 welded or otherwise secured to the front edge of bottom 36 and has a trailing grade blade 60 welded or otherwise secured to the rearwall 38. Blade 60 has substantially triangular shaped ends 59 welded across each end between the blade 60 and bucket 34 to brace the blade 60 against deflection inwardly into the hollow triangular area formed by blade 60 and bucket 34. Substantially triangular shaped braces 61 are spaced horizontally between ends 59 to further brace the blade 60.

Yoke 56, comprising a pair of spaced leg members 55a and 55b secured to cross member 57, forms a frame for attachment to the three-point hitch. Yoke 56 has lugs 62 and 64 welded or otherwise secured to cross member 57 thereof which are attached to lower bars 14 and 16 of the three-point hitch by a pin 66 extending through the lugs 62 and 64 and the ends of arms 14 and 16 and is secured thereto by means such as cotter pins 68.

Figure 2:
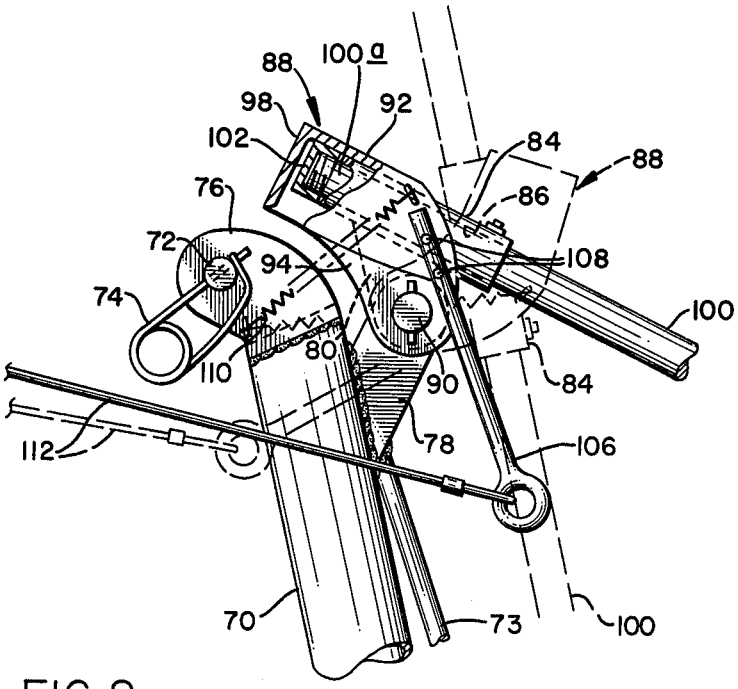
FIG. 2 is an enlarged elevational view of the bucket control apparatus with parts being broken away to further illustrate the details of construction.
Figure 6:
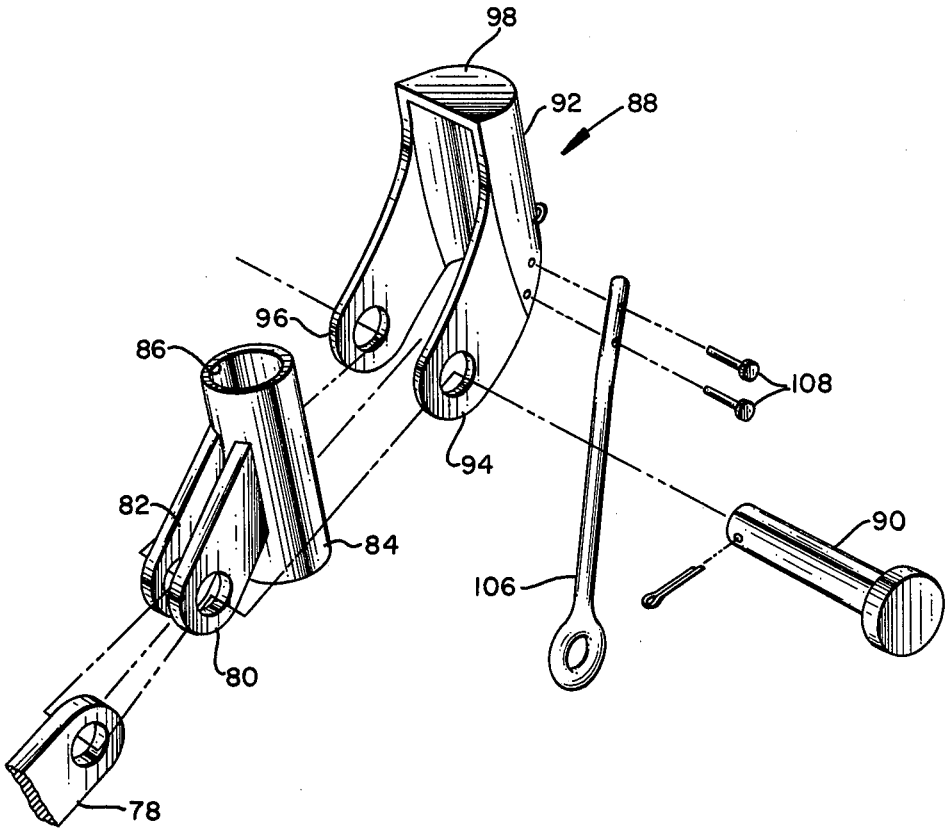
FIG. 6 is an enlarged exploded elevational perspective view of the stop member with parts broken away to more clearly illustrate the details of construction.

Yoke 56 has an upwardly extending center post 70 welded or otherwise secured thereto. Pin 72 and cotter key 74 attach the center post 70 to clevis 76 on the top link 28 of the three-point hitch. A brace member 73 is welded between the upper end of post 70 and yoke 56. As best illustrated in FIGS. 2 and 6, an ear 78 is welded or otherwise secured to the upper end of the center post 70. Lugs 80 and 82 are pivotally secured to ear 78 and are secured by welding or other means to guide sleeve 84. Guide sleeve 84 is a tubular sleeve having a bore 86 therethrough. A stop member 88 is pivotally secured to ear 78 by means such as pin 90. It should be readily apparent that the pivot point of stop member 88 and lugs 80 and 82 coincide.

Stop member 88 comprises a generally semi-circular member 92 having lugs 94 and 96 (FIGS. 2 and 6) secured thereto forming a semi-circular closure element 98 secured to the upper end thereof. From the foregoing it should be readily apparent that sleeve 84 extends between lugs 94 and 96 and pivot pin 90 pivotally secure lugs 94 and 96 and lugs 80 and 82 to ear 78 which is welded to center post 70.

A rod 100 is slideably disposed through the bore 86 of sleeve 84 and has a stop cap 102 threadedly secured at the upper end 100a of rod 100. The opposite lower end 100b of rod 100 is pivotally secured by means of pin 104 to the rear edge 38 of bucket 34.

A lever 106 is secured to stop element 88 by means of screw 108. A resilient means such as spring 110 has a first end secured to a lug secured to clevis 76 on center post 70 and a second end secured to a lug on stop member 88 such that stop member 88 is urged in a counter-clockwise direction. An actuating means, such as rope 112, has one end secured to lever 106 and is adapted to urge the lever 106 to pivot stop member 88 in a clockwise direction as viewed in FIG. 2.

It should be readily apparent from the foregoing that stop member 88 is urged in the counter-clockwise direction and that upward movement of rod 100 is limited by cap 102 abutting element 98. This allows blade 58 to grade material into bucket 34 as the tractor is moved forward without turning over to dumping position.

When rope 112 is pulled, lever 106 moves in a clockwise direction, and stop member 88 is pivoted away from contact with end **100*a* of rod 100. As blade 58 digs into the soil by movement of the tractor forward the bucket pivots about blade 58 to the position 114 shown in dashed outline in FIG. 1 to dump the contents of the bucket onto the ground. The bucket 34** may be lifted to any relative height by movement of the elevator mechanism on the three-point hitch.

Operation of the hereinbefore described device is as follows:

When the bucket is in the position shown in full outline in FIGS. 1–5 the relative heighth of the bucket is controlled by actuator control arms 18 and 20 and the angle of the bucket relative to the lower bars 14 and 16 is controlled by the length of top link 28. Movement of the tractor forward causes dirt to be scraped into the bottom of the bucket 34.

To dump the bucket, the actuating means or rope 112 is pulled to move lever 106 in a clockwise direction to pivotally move stop member 88 in a clockwise direction away from the upper rod 100. As the end of blade 58 digs into the soil and the tractor moves forward, the bucket 34 is moved to a position 114 shown in dashed outline to dump the contents of the bucket. In doing so, rod 100 slides through sleeve 84. A lug 116 is rigidly secured to side 40 of bucket 34 and engages yoke 56 in the position 116' shown in dashed outline to limit pivotal movement of bucket 34. Lug 116 limits movement of bucket 34 and establishes a relative position of bottom 36 in a generally vertical position for the dump position for forward grading with blade 58. The relative height of blade 58 is controlled by the three point hitch. It should be readily apparent that when the bucket 34 is in a dump position as shown in dashed outline, blade 58 is usable to spread the contents of the bucket 34 as it is moved forward.

In addition, lug 116 prevents undue strain on rod 100 to prevent bending of same.

To return the bucket to the pick up position shown in full outline, the tractor is moved rearward until rod 100 is pulled downward such that stop cap 102 again engages the upper end of sleeve 84 and the spring 110 urges stop members 88 over cap 102. As the tractor is moved in the forward direction, rod 100 is prevented from moving upwardly by cap 102 abutting element 98 of stop member 88.

When the bucket 34 is in the pick up position illustrated in full outline in FIG. 1, leading blade 58 moves under the soil and lifts same into bucket 34 as the tractor moves forward. The relative height of blade 58 is controlled by the three point hitch. In addition, it should be appreciated that the bucket 34 is locked in position with pivotal movement in both directions restrained by stop cap 102 engaging sleeve 84 on one end and closure element 98 on the other. Therefore movement is restricted whether the tractor moves forward or backward. When the bucket 34 is moved backward, trailing blade 60 is used to push the soil. The height of blade 60 is again controlled by the three point hitch since bucket 34 is restrained from pivotal movement.

It should be readily apparent that the vertical heighth of the bucket can be controlled by elevator mechanism control rods 18 and 20 and that the relative angle of blade 58 relative to the horizontal plane may be controlled by the length of top link 28. This length may be controlled by hydraulic cylinder to extend length or retract the length of the rod or by an adjustable manual turnbuckle or the like.

From the foregoing it should be readily apparent that the embodiment hereinbefore described accomplishes the objects of the invention hereinbefore discussed.

It should be appreciated that other and further embodiments of the invention may be devised without departing from the basic concept thereof.

Having described my invention, I claim:

1. Apparatus to attach a bucket to a hitch on a tractor comprising: a bucket having a rear wall and a bottom spaced between two sidewalls; a frame; means securing the frame to the hitch on the tractor; means pivotally securing the bucket to the frame; a sleeve; means pivotally securing the sleeve to the frame; a rod slideably disposed through the sleeve; means pivotally securing a first end of the rod to the upper rear wall of the bucket such that as the bucket pivots on the frame the rod slides within the sleeve; a stop member pivotally secured over the upper end of the sleeve arranged to limit the upward movement of the rod in the sleeve; means to move the stop member from a position over the upper end of the sleeve and rod to a position away from the upper end of the rod allowing passage of the rod upwardly through the sleeve as the bucket pivots in the frame to dump the contents of the bucket.

2. The combination called for in claim 1 wherein the frame comprises: a yoke; and an upwardly extending center post.

3. The combination called for in claim 1 wherein the means pivotally securing the bucket to the frame comprises: stub shafts secured to each of the sidewalls on the bucket, the stub shafts being rotatably secured to the frame.

4. The combination called for in claim 1 with the addition of: a stop cap secured to the upper end of the rod to limit downward movement of the rod through the sleeve.

5. The combination called for in claim 1 wherein the leading edge of the bottom of the bucket has a blade secured thereto for guiding the material into the bucket.

6. The combination called for in claim 1 wherein the stop member comprises: a semi-circular cylindrical member; a pair of lugs secured to the cylindrical member; and a closure element secured to the upper end of the cylindrical member arranged to abut the upper end of the rod.

7. The combination called for in claim 1 wherein the means to move the stop member comprises: a resilient element to urge the stop member over the upper end of the rod; a lever; and means to move the lever to move the stop member away from the upper end of the rod.

8. The combination called for in claim 1 with the addition of: means on the bucket engageable with the frame to limit pivotal movement of the bucket.

9. Apparatus to attach a bucket to a three-point hitch on a tractor comprising: a bucket having a rear wall and a bottom wall spaced between two sidewalls; a blade secured to the leading edge of the bottom wall; a frame; means to pivotally secure the bucket to the frame; means securing the frame to the bottom portion of the hitch; a center post extending upwardly from the frame, the upper end of the center post being secured to the upper portion of the hitch; a sleeve; means pivotally securing the sleeve to the upper portion of the center post; a rod slideably disposed through the sleeve, the rod having one end pivotally secured to the upper central portion of the rear wall of the bucket such that as the bucket pivots within the frame the rod moves through the sleeve; a stop cap secured to the upper end of the rod to limit downward movement of the rod; a stop member consisting of a semi-circular cylindrical unit having a closure element formed on the upper end thereof, the stop member being pivotally secured over the sleeve; a lever secured to the stop member; and means to move the lever to pivot the stop member from a first position over the sleeve wherein the upper end of the rod abuts the closure element limiting upward movement of the rod to a second position pivoting the stop member away from the sleeve allowing upward movement of the rod to allow the bucket to pivot forward to dump the content of the bucket.

10. The combination called for in claim 9 with the addition of spring means between the stop member and the center post to urge the stop member in a counterclockwise direction.

11. A bucket attachment connectable to a hitch on a tractor comprising: a bucket; a frame; means pivotally securing said bucket to said frame; means pivotally securing said frame to the hitch on the tractor; a support member; means rigidly securing said support member to said frame; a rod having a first end pivotally secured to said bucket; guide means pivotally secured to said support means and slideably secured to a second end of said rod; first stop means on the second end of said rod to limit movement of said rod relative to said guide means in a first direction; second stop means secured to said guide means to limit movement of the rod in a second direction relative to said guide means; and means to move said second stop means relative to said guide means to release said rod to allow the rod to more relative to the guide means to allow pivotal movement of the bucket relative to the frame.

* * * * *